US012698708B2

(12) United States Patent
Jain

(10) Patent No.: US 12,698,708 B2
(45) Date of Patent: Aug. 4, 2026

(54) METHODS FOR DETERMINING A POSITION OF A DROPPABLE OBJECT IN A WELLBORE

(71) Applicant: Schlumberger Technology Corporation, Sugar Land, TX (US)

(72) Inventor: Bipin Jain, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 70 days.

(21) Appl. No.: 18/861,041

(22) PCT Filed: Apr. 28, 2022

(86) PCT No.: PCT/US2022/071978
§ 371 (c)(1),
(2) Date: Oct. 28, 2024

(87) PCT Pub. No.: WO2023/211508
PCT Pub. Date: Nov. 2, 2023

(65) Prior Publication Data

US 2025/0347217 A1 Nov. 13, 2025

(51) Int. Cl.
*E21B 47/095* (2012.01)
*E21B 33/16* (2006.01)
*E21B 47/18* (2012.01)

(52) U.S. Cl.
CPC ..... *E21B 47/095* (2020.05); *E21B 33/16* (2013.01); *E21B 47/18* (2013.01)

(58) Field of Classification Search
CPC ..... E21B 33/16; E21B 47/095; E21B 47/18
See application file for complete search history.

(56) References Cited

U.S. PATENT DOCUMENTS 2,232,593 A * 2/1941 Diescher ..... E21B 17/08 285/288.1
4,384,737 A * 5/1983 Reusser ..... F16L 15/004 285/369

(Continued)

FOREIGN PATENT DOCUMENTS

WO 2018004369 A1 1/2018
WO 2022025790 A1 2/2022
WO 2022131951 A1 6/2022

OTHER PUBLICATIONS

International Search Report and Written Opinion issued in International Patent application PCT/US2022/071978 on Jul. 7, 2022, 22 pages.

(Continued)

*Primary Examiner* — Shane Bomar
(74) *Attorney, Agent, or Firm* — Kyle R. Miiller

(57) ABSTRACT

The position of a droppable object (e.g., a cementing plug or drillpipe dart) in a cased wellbore may be determined in real time during a cementing operation. A pressure data acquisition system is installed at a wellsite and a pressure transducer is installed at the wellhead. As the droppable object travels through casing it encounters regions with a positive or a negative change of inner cross-sectional dimension. The droppable object generates a pressure pulse as it passes through the regions. The pressure pulse and associated reflections are detected by the pressure transducer, and the signals are processed mathematically to determine the position of the droppable object. Special casing joints may be installed that comprise positive dimensional upsets that have a size of at least 3 mm. Such upsets may ensure the generation of pressure pulses of sufficient magnitude for detection by the pressure transducer.

21 Claims, 11 Drawing Sheets

(56) References Cited

U.S. PATENT DOCUMENTS

| | | | | |
|---|---|---|---|---|
| 4,819,726 | A | 4/1989 | Beirute | |
| 5,754,495 | A | 5/1998 | Skinner | |
| 6,364,368 | B1 * | 4/2002 | Kilgore | F16L 15/005 285/251 |
| 6,401,814 | B1 | 6/2002 | Owens | |
| 9,534,471 | B2 * | 1/2017 | Etzel | E21B 43/14 |
| 9,546,548 | B2 | 1/2017 | Hartog | |
| 10,107,064 | B2 | 10/2018 | Richards | |
| 11,131,183 | B2 * | 9/2021 | Mericas | E21B 47/06 |
| 2002/0157828 | A1 | 10/2002 | King | |
| 2015/0285066 | A1 | 10/2015 | Keller | |
| 2017/0122096 | A1 | 5/2017 | Durtler | |
| 2018/0334881 | A1 * | 11/2018 | Dallas | E21B 17/006 |
| 2021/0062640 | A1 | 3/2021 | Demidov | |
| 2021/0148219 | A1 | 5/2021 | Mericas | |

OTHER PUBLICATIONS

Leugemors et al.: "Cementing Equipment and Casing Hardware," in Nelson EB and Guillot D (eds.): Well Cementing-2nd Edition, Houston, Schlumberger (2006) 343-458.

Piot et al., "Primary Cementing Techniques," in Nelson EB and Guillot D (eds.): Well Cementing-2nd Edition, Houston, Schlumberger (2006) 459-501.

Trogus et al., "Studies of Cement Wiper Plugs Suggest New Deepwater Standards," paper SPE/IADC-173066-MS, presented at the SPE/IADC Drilling Conference and Exhibition, London, UK, Mar. 17-19, 2015, 9 pages.

* cited by examiner

METHODS FOR DETERMINING A POSITION OF A DROPPABLE OBJECT IN A WELLBORE

TECHNICAL FIELD

This application is a National Stage Entry of PCT/US2022/071978, filed Apr. 28, 2022. The present disclosure relates generally to cementing operations. In particular, the disclosure relates to using pressure pulses to determine the positions of wiper plugs and drillpipe darts inside a casing string

BACKGROUND

During the construction of underground wells, it is common, during and after drilling, to place a tubular body such as a liner or casing, secured by cement pumped into the annulus around the outside of the tubular body. The cement serves to support the tubular body and to provide isolation of the various fluid-producing zones through which the well passes. This latter function prevents cross-contamination of fluids from different layers. For example, the cement prevents formation fluids from entering the water table and polluting drinking water, or prevents water from passing into the well instead of oil or gas. Furthermore, the cement sheath helps prevent corrosion of the tubular body.

The cement placement process is known in the industry as primary cementing. Most primary cementing operations employ the two-plug cement-placement method. FIG. 1 shows a typical wellsite configuration 100 for a primary cementing operation. A cementing head 101 is situated on the surface, and a casing string 103 is lowered into a borehole 102. As the casing string 103 is lowered into the borehole 102, the casing string interior fills with drilling fluid 108. The casing string is centered in the borehole by centralizers 104 attached to the outside of the casing string. Centralizers are placed in critical casing sections to prevent sticking while the casing is lowered into the well. In addition, they keep the casing string in the center of the borehole to help ensure placement of a uniform cement sheath in the annulus between the casing and the borehole. The bottom end of the casing string is protected by a guide shoe 105 and a float collar 109. Guide shoes are tapered, commonly bullet-nosed devices that guide the casing toward the center of the hole to minimize hitting rough edges or washouts during installation. The guide shoe differs from the float collar in that it lacks a check valve. The check valve in a float collar can prevent reverse flow, or U-tubing, of fluids from the annulus into the casing. Inside the cementing head 101 are a bottom cementing plug 106 and a top cementing plug 107. The cementing plugs, also known as cement wiper plugs or wiper plugs, are elastomeric devices that provide a physical barrier between different fluids as they are pumped through the casing string interior. Most cementing plugs are made of a cast aluminum body with molded rubber fins.

The goals of the primary cementing operation are to remove drilling fluid from the casing interior and borehole, place a cement slurry in the annulus, and leave the casing interior filled with a displacement fluid such as brine or water. The bottom cementing plug 106 separates the cement slurry from the drilling fluid, and the top cementing plug 107 separates the cement slurry from the displacement fluid.

Cement slurries and drilling fluids are usually chemically incompatible. Commingling may result in a thickened or gelled mass at the interface that would be difficult to remove from the wellbore, possibly preventing the placement of a uniform cement sheath throughout the annulus. Therefore, in addition to using wiper plugs, engineers employ both chemical means to maintain fluid separation. Chemical washes and spacer fluids may be pumped between the cement slurry and drilling fluid. These fluids have the added benefit of cleaning the casing and formation surfaces, which is helpful for achieving good bonding with the cement.

FIG. 2 shows a chemical wash 201 and a spacer fluid 202 being pumped between the drilling fluid 108 and the bottom cementing plug 106. Cement slurry 203 follows the bottom cementing plug. The bottom cementing plug has a membrane that ruptures when it lands at the bottom of the casing string, allowing cement slurry to pass through the bottom cementing plug and enter the annulus (FIG. 3).

Once a sufficient volume of cement slurry has been pumped to fill the annular region between the casing string and the borehole wall, the top cementing plug 107 is released, followed by the displacement fluid 301. The top cementing plug 107 does not have a membrane; therefore, when it lands, hydraulic communication is severed between the casing interior and the annulus (FIG. 4). After the cementing operation, engineers wait for the cement to set and develop strength-known as "waiting-on-cement" (WOC). After the WOC time, further operations such as drilling deeper or perforating the casing string may commence.

Conventional cementing plugs are pumped directly from the surface because they pass through only one pipe with a continuous inside diameter (ID). Liners, on the other hand, do not begin at the surface; instead, they are run downhole on the drillstring to the setting depth. Liners typically have a much larger ID than the drillstring; as a result, a single cementing plug cannot be pumped from the surface. Therefore, the displacement is performed by two plugs. One plug, known as the drillpipe dart, is located in the surface cementing equipment. The second plug is either attached to the bottom of the liner setting tool assembly, or the top of the liner setting tool assembly. The second plug is called a liner wiper plug.

After the cement has been pumped in the liner and the drillstring, the drillpipe dart is released from the surface cementing equipment. When the drillpipe dart reaches the top of the liner, it latches into the liner wiper plug. Both the drillpipe dart and the liner wiper plug then become a single divider between the cement slurry and the displacement fluid. This arrangement may be seen in extended-reach wells and multistage cementing applications.

Additional information concerning cementing plugs, drillpipe darts and primary cementing operations may be found in the following publications. Leugemors E et al.: "Cementing Equipment and Casing Hardware," in Nelson EB and Guillot D (eds.): *Well Cementing—2nd Edition*, Houston, Schlumberger (2006) 343-458. Piot B and Cuvillier G: "Primary Cementing Techniques," in Nelson EB and Guillot D (eds.): *Well Cementing—2nd Edition*, Houston, Schlumberger (2006) 459-501. Trogus M: "Studies of Cement Wiper Plugs Suggest New Deepwater Standards," paper SPE/IADC-173066-MS, presented at the SPE/IADC Drilling Conference and Exhibition, London, UK, 17-19 Mar. 2015.

Deviations from the idealized cementing operation depicted above may occur. Possible reasons include borehole rugosity leading to inaccurate displacement volume calculations, pump rate fluctuations, differences between nominal and actual casing geometry, lost circulation, casing deformation and fluid loss. With these uncertainties, operators and engineers are motivated to achieve real-time monitoring of cementing plug positions, as well as locate the top of the cement sheath in the annulus.

BRIEF DESCRIPTION OF THE DRAWINGS

FIG. 8(*i*)(*a*) is a plot of wellhead pressure versus flowrate; FIG. 8(*i*)(*b*) shows the wellhead pressure spectrogram; FIG. 8(*ii*)(*c*) shows the normalized energy spectral density; FIG. 8(*ii*)(*d*) is a plot of displaced volume and estimated cementing plug depth versus time; FIG. 8(*ii*)(*e*) is a plot of measured pressure pulses arising from the cementing plug passing through casing collars.

SUMMARY

Figure 1:
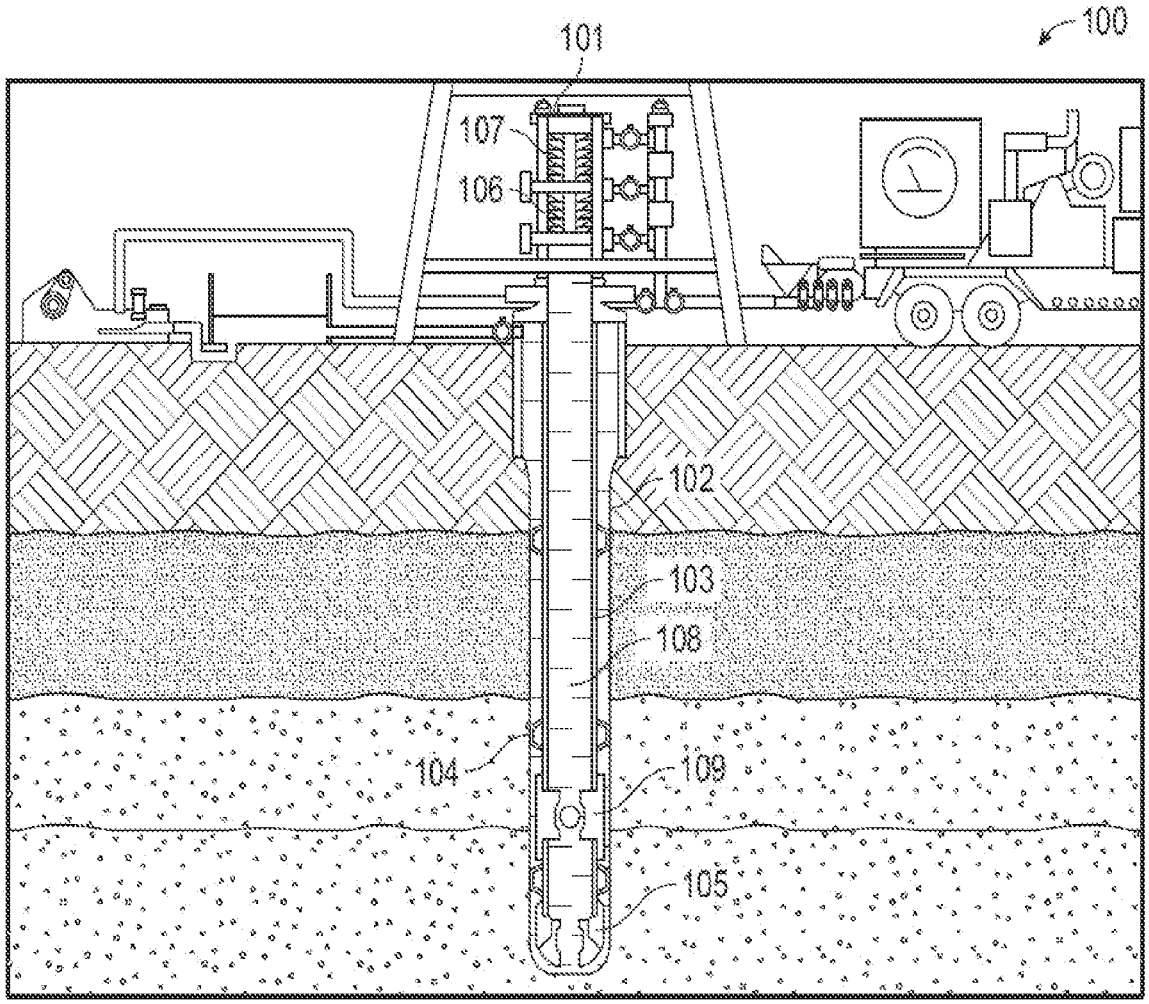
Figure 1 PRIOR ART
FIG. 1 shows a typical wellsite configuration during a cementing operation.
Figure 2:
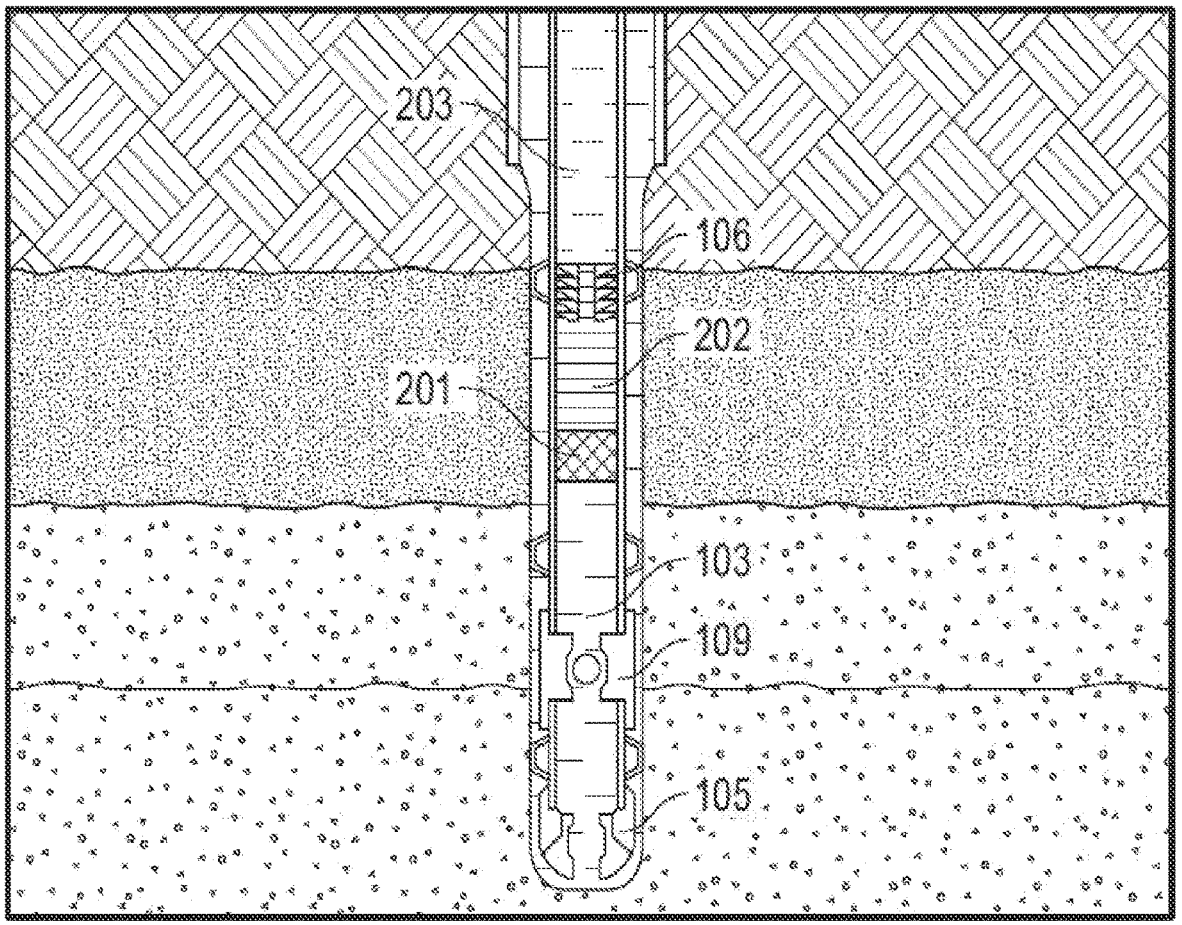
Figure 2 PRIOR ART
FIG. 2 shows a cementing operation in progress. The bottom cementing plug has been released, separating the cement slurry from chemical washes, spacer fluids and drilling fluid.
Figure 3:
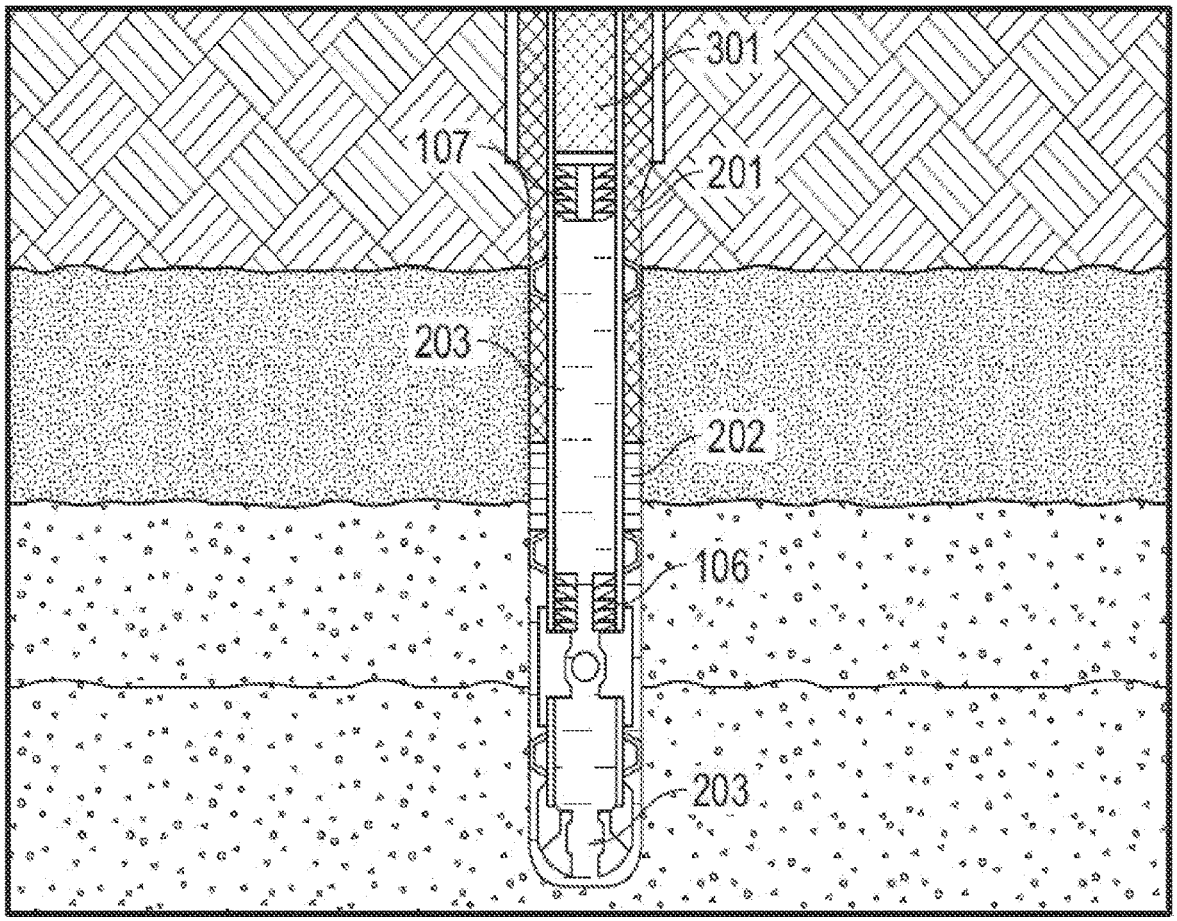
Figure 3 PRIOR ART
FIG. 3 shows a cementing operation in progress. The bottom cementing plug has landed on the float collar. A membrane in the bottom cementing plug ruptures, allowing cement slurry to enter the annulus between the casing string and the borehole wall.
Figure 4:
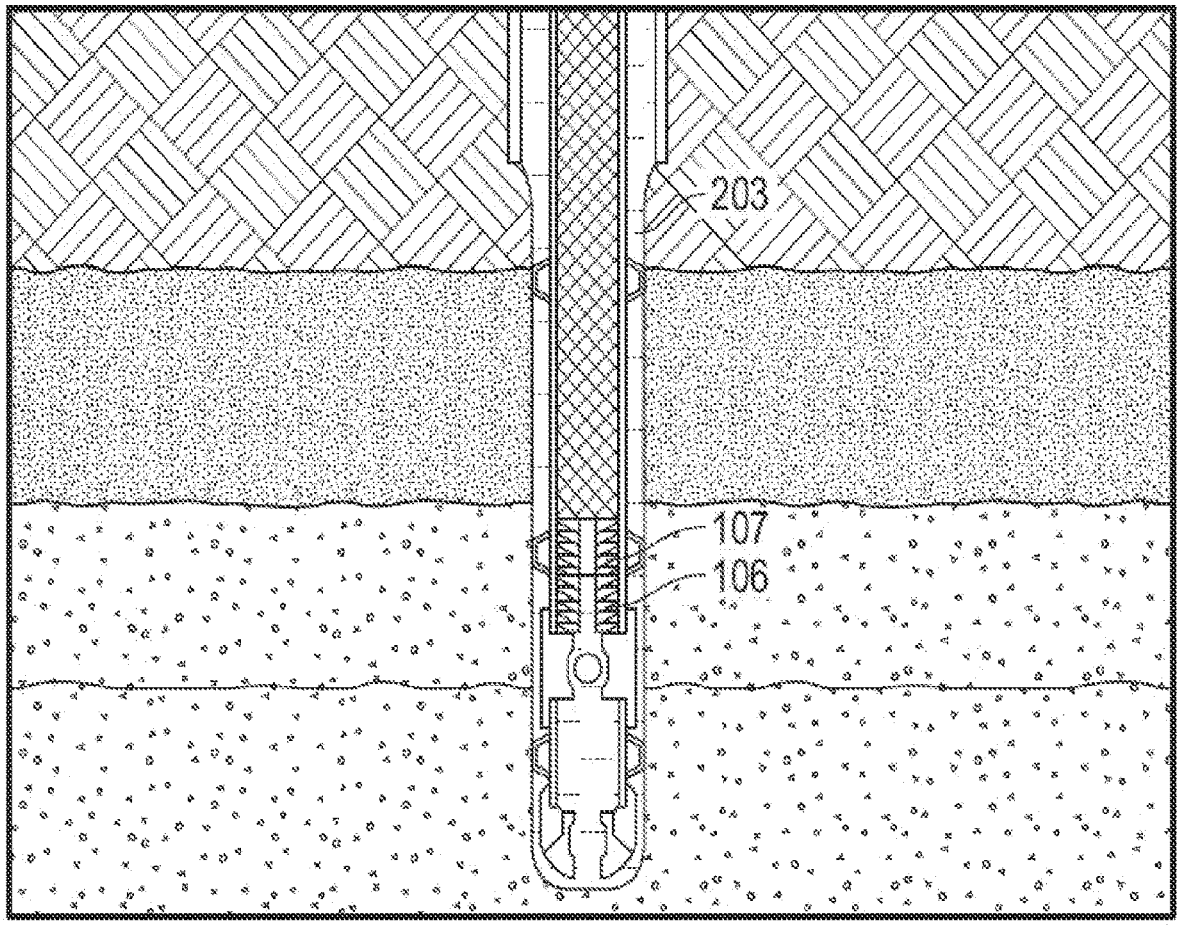
Figure 4 PRIOR ART
FIG. 4 shows a completed cementing operation. Cement slurry fills the annulus, both cementing plugs have landed on the float collar, and the interior of the casing string is filled with displacement fluid.

In an aspect, embodiments relate to an apparatus comprising a droppable object and a casing joint that comprises at least two positive upsets.

In a further aspect, embodiments relate to methods for determining a position of a droppable object inside a casing string. The casing string is installed into a liquid filled borehole, wherein the casing string comprises at least one casing joint with at least two positive upsets. A pressure data acquisition system is installed at a wellsite, and a pressure transducer is installed at a wellhead.

A droppable object is placed inside the casing string, and a fluid is pumped behind the droppable object, causing the droppable object to travel through the interior of the casing string and pass through the at least one casing joint that comprises at least two positive upsets having a size of at least 3 mm, but smaller than that which would prevent passage of the droppable object through the inside of the casing string, thereby generating a pressure pulse.

The pressure data are recorded by a pressure transducer, and transmitted to the pressure data acquisition system. The pressure data are then processed mathematically by obtaining the pressure pulses, pulse reflections or both. The position of the droppable object is then determined.

In a further aspect, embodiments relate to methods for cementing a borehole penetrating a subterranean formation. A casing string is installed into a liquid filled borehole. The casing string comprises at least one casing joint that comprises at least two positive upsets.

A pressure data acquisition system is installed at a wellsite, and at least one pressure transducer is installed at a wellhead. A top cementing plug is placed inside the casing string. A displacement fluid is then pumped behind the top cementing plug, causing the top cementing plug to travel through the interior of the casing string and pass through the at least two positive upsets having a size of at least 3 mm, but smaller than that which could prevent passage of the top cementing plug through the casing string, thereby generating a pressure pulse.

The at least one pressure transducer is used to detect the pressure pulse and transmit pressure data to the pressure data acquisition system. The pressure data comprise pressure pulse propagation velocity and reflection time. The pressure data are then processed mathematically and the position of the top cementing plug is determined.

DETAILED DESCRIPTION

At the outset, it should be noted that in the development of any such actual embodiment, numerous implementations-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. Also, in the summary of the disclosure and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific points, it is to be understood that inventors appreciate and understand that any and all data points within the range are to be considered to have been specified, and that inventors possessed knowledge of the entire range and all points within the range.

This disclosure pertains to detecting the position of droppable objects in a casing string or liner during a well cementing operation. The droppable objects may comprise top or bottom cementing plugs and drill pipe darts. The method is based on generating pressure pulses in a well, recording high frequency pressure data, mathematical processing of the recorded data with extraction of pressure pulses reflections from downhole objects, measuring the pulse reflection times and computing the distance from a known position of the pressure transducer to the droppable object. The methods and measurements disclosed herein may be performed in real time during a cementing operation. The ability to locate droppable objects in real time allows operators to make instant decisions concerning the progress of the treatment, for example, whether to continue or discontinue displacement, volumes of fluids to be introduced into the wellbore and pumping rates.

A method and system for locating downhole objects that reflect a hydraulic signal are disclosed in the patent application WO 2018/004369. The monitoring of the well is based on cepstral analysis of pressure data recorded at the wellhead. It is designed to locate downhole objects that reflect a hydraulic signal. A hydraulic signal is detected by a pressure sensor, then the pressure data are processed to obtain their properties such as tube wave reflection times. One (but not the only) method of obtaining such information is a cepstrum analysis. The cepstrum analysis is widely used in various applications, for example for hydraulic fracturing operations monitoring. The cepstrogram allows detection of objects that reflect the hydraulic signal. This method for hydraulic fracturing operations uses hydraulic signal sources including the water hammer effect, noise from surface or submersible pumps and perforating events.

U.S. Pat. No. 6,401,814 B1 discloses a method for locating a cementing plug in a subterranean well during cementing operations using pressure pulse reflections. Once generated, pressure pulses are transmitted through displacement fluid, reflected off the cementing plug and, finally, received by a pressure sensor. A location of the plug is calculated from reflection time and pressure pulse velocity in the given media. The method of generating and transmitting of pressure pulse through the fluid in a casing string comprises momentarily opening a valve installed in the flowline of the well. Other methods of pressure pulse generation include an air gun, varying the pump's engine speed or disengaging the pump.

U.S. Pat. No. 5,754,495 discloses a method for acoustic determination of the length of a fluid conduit. It comprises constructing a pressure containment system, connecting pressure sensors, filling the system with a fluid, generating a pressure pulse, measuring a pressure pulse traveling to the distal end of the fluid conduit, and calculating the length of the fluid conduit. In the embodiment, a tube wave is generated by a sudden release of pressure in the well through a valve.

U.S. Pat. No. 4,819,726 discloses a method for indicating the position of a cement wiper plug prior to its bottomhole arrival. It comprises an apparatus that includes a section of pipe string with an interior shearable, temporary means of restricting the motion of the cement wiper plug through the section of pipe string. The arrival of the cementing plug at the shearable, temporary restriction means in a pipe string is sensed by an increase in pipe string pressure at the surface and monitored by a pressure sensor.

U.S. Pat. No. 9,546,548 discloses a device and method of use for cement sheath analysis based on acoustic wave propagation. It consists of an acoustic wave detection apparatus, comprising a fiber optic cable drawn down in a well, an optical source and a data acquisition system. The acoustic source produces a compressional wave in a casing string. The pressure in the annulus is determined as the cement slurry sets, and this pressure is compared to the maximum formation pressure as an indication of whether the cement had set to a strength, enough to maintain an effective formation-to-casing seal across the annulus.

In the methods disclosed in this application, pressure pulses are generated when a cementing plug passes through casing collar joints where a variation of inner diameter of the casing takes place. Computation of the distance is based on determining the velocity of tube waves generated by the pressure pulses, and the travel time of the tube wave between the pressure transducer and the droppable object. Reflection times are obtained through the cepstrum analysis of recorded high frequency pressure data. As described in patent application WO 2018/004369 referenced above, a cepstrum is the result of taking the inverse Fourier transform (IFT) of the logarithm of the estimated spectrum of a signal. Tube wave velocity may be obtained using computed pressure pulse reflection time from the objects in wellbore with a known position, for example a landing collar, or calculated theoretically based on parameters including properties of the liquid medium and the casing geometry. Another embodiment utilizes the identification of wiper plug position based on pressure pulse generation and the information about the casing joint sequence-called a casing tally. It comprises pressure pulse generation by the wiper plug passing through the collar, its detection and matching with its depth taken from the casing tally table.

Figure 5:
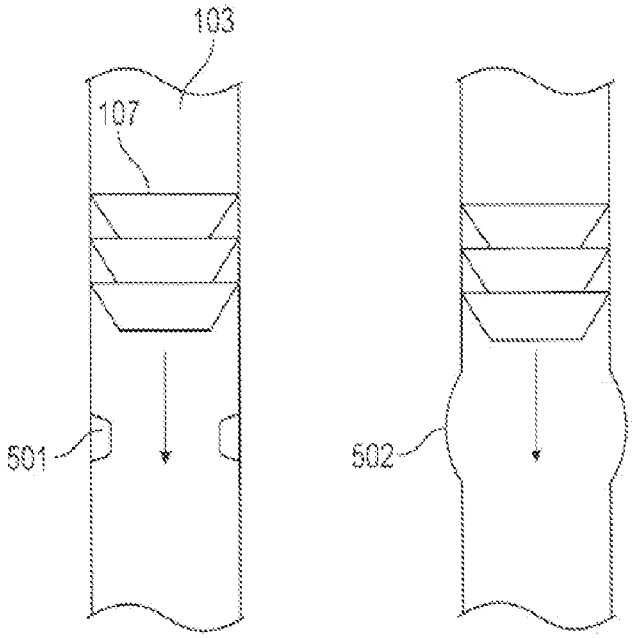
FIG. 5 is an illustration of a cementing plug passing through a region of casing pipe with a negative and a positive change of inner cross-sectional dimension.
Figure 6:
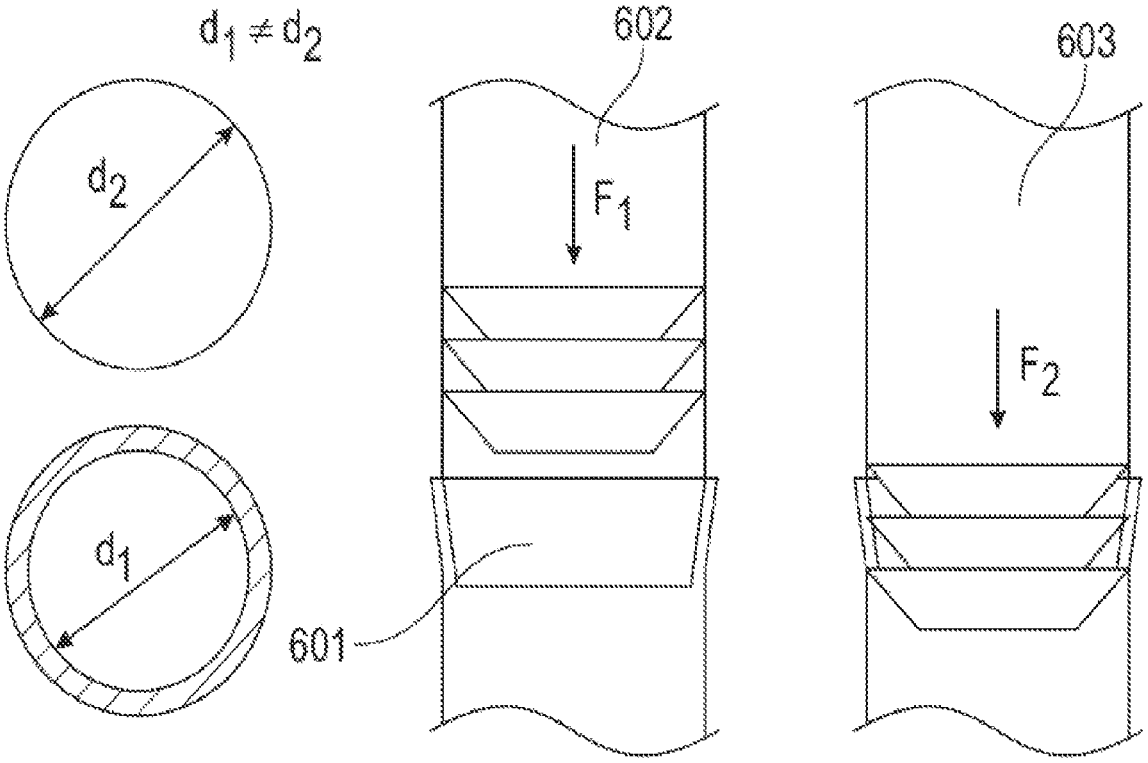
FIG. 6 is an illustration of a cementing plug passing through a casing joint with an inner cross-sectional dimension $d_1$, which is different from the rest of the casing $d_2$.

One embodiment of the disclosure is a system that comprises at least two casing pipes joined together to form a casing string and placed in the borehole (FIG. 5). A cementing plug 107 is dropped into a casing string 103 filled with a fluid. At least one pipe in the casing string may have a region with at least one change of inner cross-section dimension. The change of inner cross-section dimension can be negative 501 or positive 502 with respect to the inner cross-sectional dimension of the rest of the pipe. The change of inner cross-sectional dimension may occur at casing pipe joints, which may be screw joints 601, weld joints or both (FIG. 6). A pressure pulse is generated when the cementing plug passes through the region with the change of inner cross-sectional dimension (501, 502, or 601) due to the difference in forces (602, 603) required to push the cementing plug through the region $d_1$ and the rest of the pipe $d_2$. The change of inner cross-sectional dimension may further be a restriction, a groove, a lug, or an orifice or a combination thereof. Furthermore, the distances between regions with at least one change of inner cross-sectional dimension may be equidistant or nonequidistant, or both.

Figure 7:
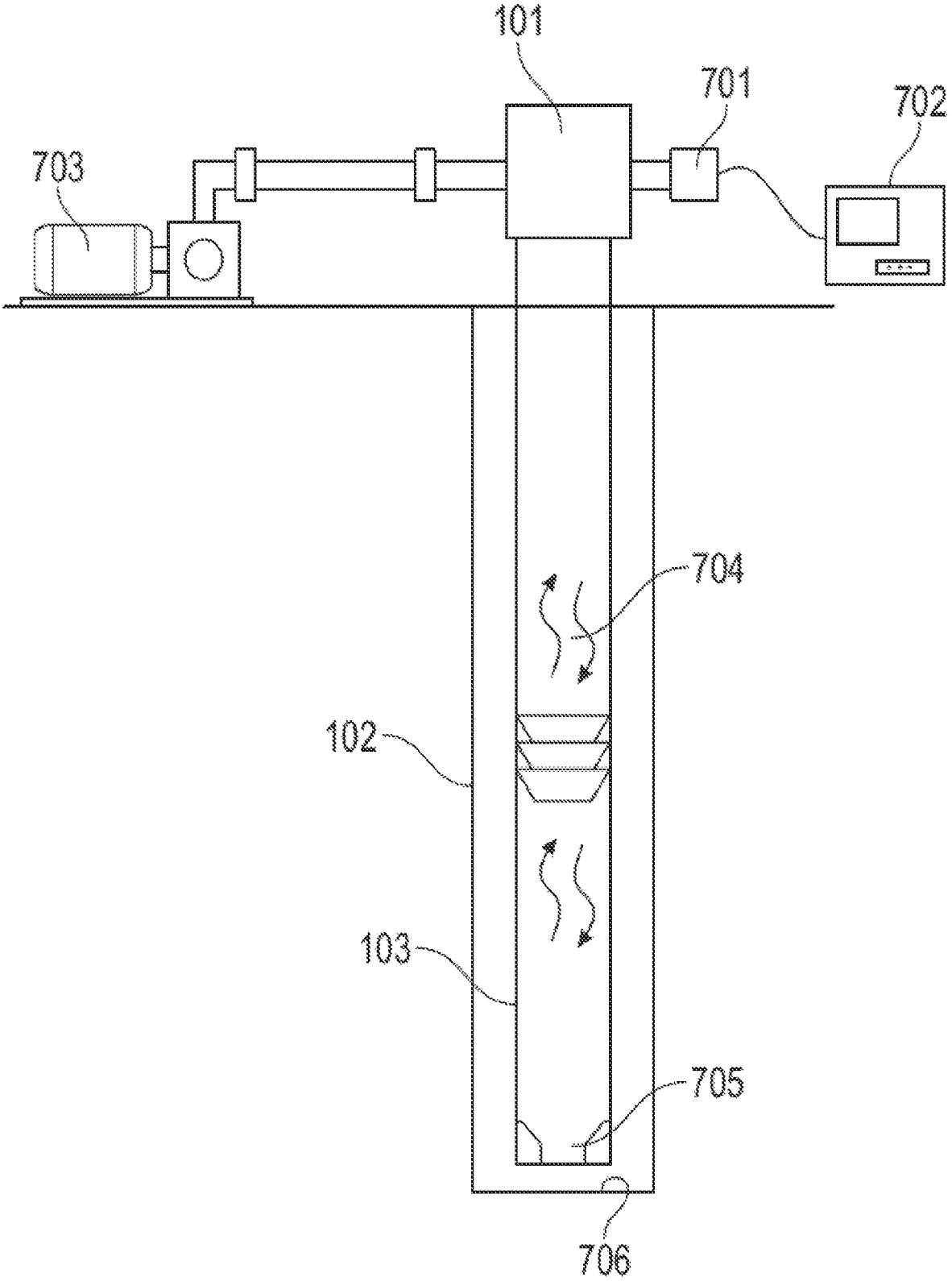
FIG. 7 is an illustration of a well configuration for practicing the disclosed methods.

The disclosed method employs an assembly (FIG. 7) that comprises a borehole 102, fluid-filled casing string run into borehole 103, a pressure transducer 701 installed at the casing string at the surface (wellhead or cementing head), an acquisition system 702 for pressure data recording, and at least one pump 703 connected to the casing string via the cementing head 101. The pressure transducer may be installed at a fluid pumping line, for example at the cementing head. Or, the pressure transducer may be installed at the annular side of the casing (e.g., at a blowout preventer). The pressure pulses may be recorded within a frequency range between 20 and 2000 Hz. Once generated, a pressure pulse 704 may propagate in the fluid-filled borehole and reflect from various objects. The pulse reflection objects are any physical or geometrical changes in the borehole and casing string, that may include, but are not limited to moving objects such as a cementing plug 107, top of cement and fluid interfaces, or stationary objects such as a landing collar 705, a liner, a check valve, a bottomhole 706, fractures and vugs. Pulse propagation and reflection may occur several times until they completely attenuate. Pulse reflections from various objects are detected by the pressure transducer installed at the surface and data are captured by the acquisition system. Recorded pressure data are then processed with a mathematical algorithm and reflection times from various objects are obtained. The mathematical algorithm may be cepstral analysis, comprising production of a pressure cepstrogram in coordinates of quefrency and time, and calculation of pressure pulse reflection time from the droppable object. The location of the object relative to known position of pressure transducer is then calculated by multiplication of the reflection half-time by the velocity of pulse propagation in the media filling the volume between the pressure transducer and the object. The reflection time from the droppable object may be converted to the position of the droppable object by multiplication by tube wave velocity.

Persons skilled in the art will recognize that the disclosed methods may further comprise placing a bottom cementing plug inside the casing string. Cement slurry may be pumped behind the bottom cementing plug. The bottom cementing plug may travel through the interior of the casing string and pass through at least one region with a negative or a positive change of inner cross-sectional dimension, thereby generating a pressure pulse. The at least one pressure transducer may be used to detect the pressure pulse and transmit pressure data to the pressure data acquisition system. The pressure data may comprise a pressure pulse propagation velocity and a reflection time. The pressure data may be processed mathematically and the position of the bottom cementing plug may be determined. Monitoring of the bottom cementing plug may proceed at least until the top cementing plug is launched.

In another embodiment the velocity of pressure pulse propagation in the media is taken from measurements while cementing a previous section or a neighboring well with similar characteristics.

Locating the object may be performed in real time during the cementing operation. It is implemented via recording and mathematical processing of the pressure signal followed by object positioning directly during the cementing operation. A computer with specific software may perform immediate data processing and building a tracking diagram of the object.

Another embodiment uses information about the casing joint sequence called the casing tally. The casing tally is a table that stores the lengths and positions of all casing collars. The pulse generated by the cementing plug passing a collar can be matched with its depth taken from the casing tally table as illustrated in FIGS. 8(*i*), 8(*ii*) and 9.

Figure 8I:
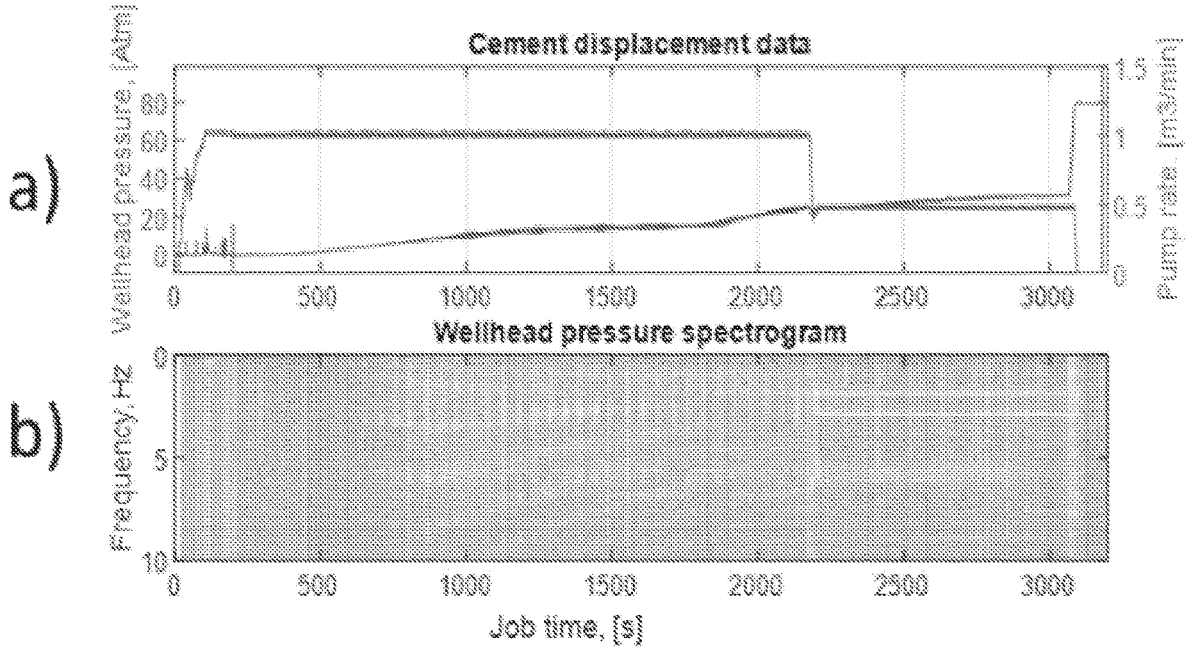
FIGS. 8(*i*) and 8(*ii*) show the computation workflow for determining pressure pulses arising from cementing plugs passing through casing collars.
Figure 8:
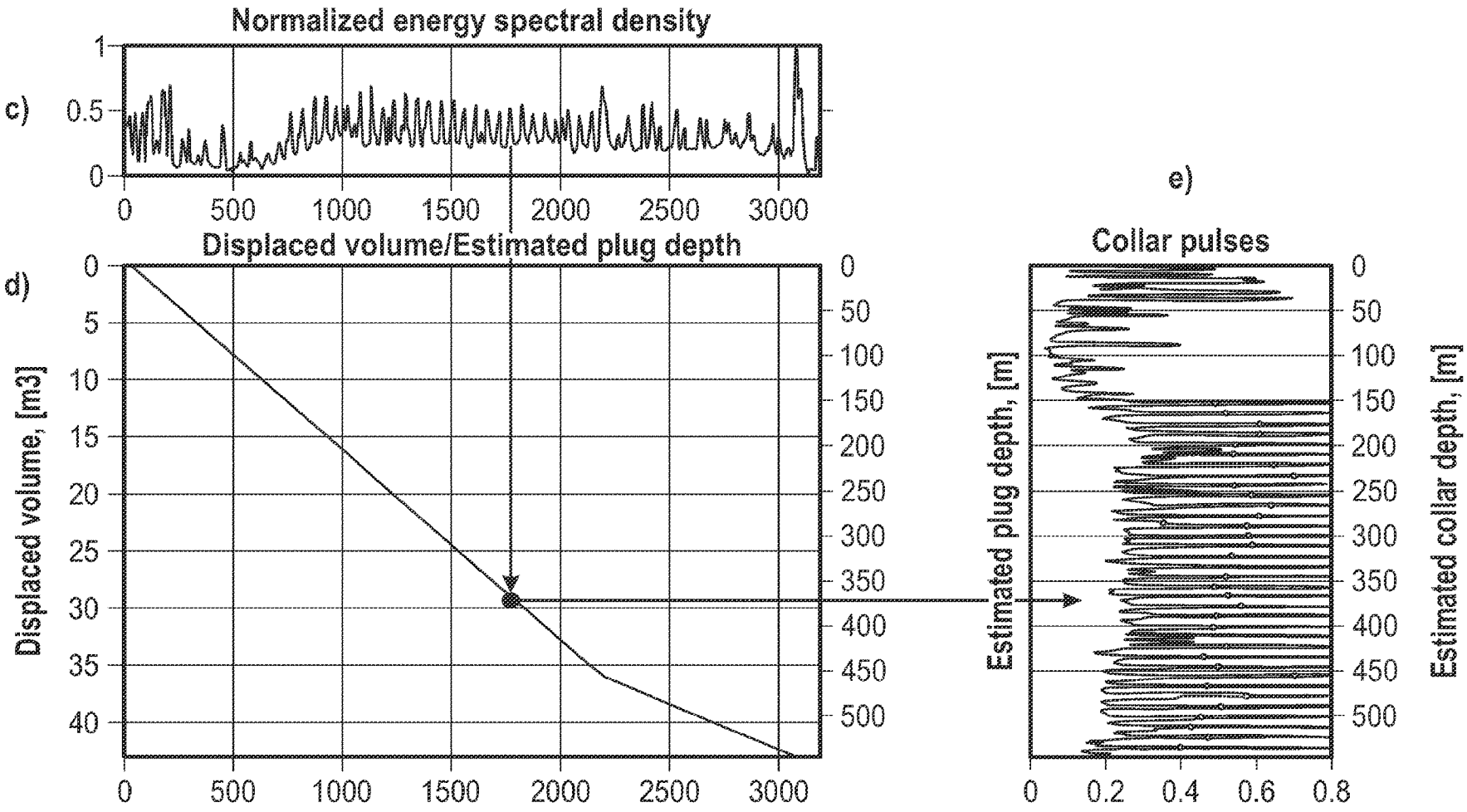

The high frequency pressure and pump rate are shown in FIG. 8(*i*)(*a*). The spectrogram of the pressure signal is a visual representation of the spectrum of frequencies of the signal as it varies with time, shown in FIG. 8(*i*)(*b*). Although the pressure pulses are not recognizable on the pressure curve they are clearly seen on the spectrogram as broadband events. Furthermore, these pulses manifest themselves as peaks on the normalized energy spectral density plot shown in FIG. 8(*ii*)(*c*).

Energy spectral density describes how the energy of a signal is distributed with frequency. The term "energy" is used in the generalized sense of signal processing; that is, the energy E of a signal x(t) is:

$$E = \int_{-\infty}^{\infty} |x(t)^2| dt \tag{1}$$

The energy spectral density is most suitable for transients—e.g., pulse-like pressure signals—having a finite total energy. In this case, Parseval's theorem provides an alternate expression for the energy of the signal:

$$\int_{-\infty}^{\infty} |x(t)|^2 dt = \int_{-\infty}^{\infty} |\hat{x}(f)|^2 df \tag{2}$$

where $$x(f) = \int_{-\infty}^{\infty} e^{-2\pi i f t} x(t) dt \tag{3}$$

is the Fourier transform of the signal and f is the frequency in Hz. Often used is the angular frequency $\omega=2\pi f$. Since the integral on the right-hand side is the energy of the signal, the integrand $|\hat{x}(f)|^2$ can be interpreted as a density function describing the energy per unit frequency f. In light of this, the energy spectral density of a signal x(t) is defined as:

$$S_{xx}(f) = |\hat{x}(f)|^2. \tag{4}$$

The normalized energy spectral density is computed by integrating the spectrogram along the frequency axis followed by normalization by the strongest peak. The normalized energy spectral density is therefore a dimensionless quantity. From FIG. 8(*ii*)(*c*) it is also shown that the time interval between these peaks depends on the pump rate. The time interval is shorter at the pump rate of 1 $m^3$/min and longer at the pump rate of [0.5 $m^3$/min (3.1 bbl/min)]. A convenient way to correct for a non-constant pump rate is to convert the time scale to the estimated depth scale as shown in FIG. 8(*ii*)(*d*). By integrating the pump rate over time, the displaced volume curve may be computed. The displaced volume scale in reverse order is shown on the left y-axis of FIG. 8(*ii*)(*d*). Taking into account the inner casing diameter, the estimated depth scale may be computed as shown by the right y-axis of FIG. 8(*ii*)(*d*). The horizontal time scale from FIG. 8(*ii*)(*c*) is mapped with the displaced volume curve to determine the estimated cementing plug depth. The normalized energy spectral density information may be plotted against estimated depth scale to produce a collar pulses plot, shown in FIG. 8(*ii*)(*e*).

Figure 9:
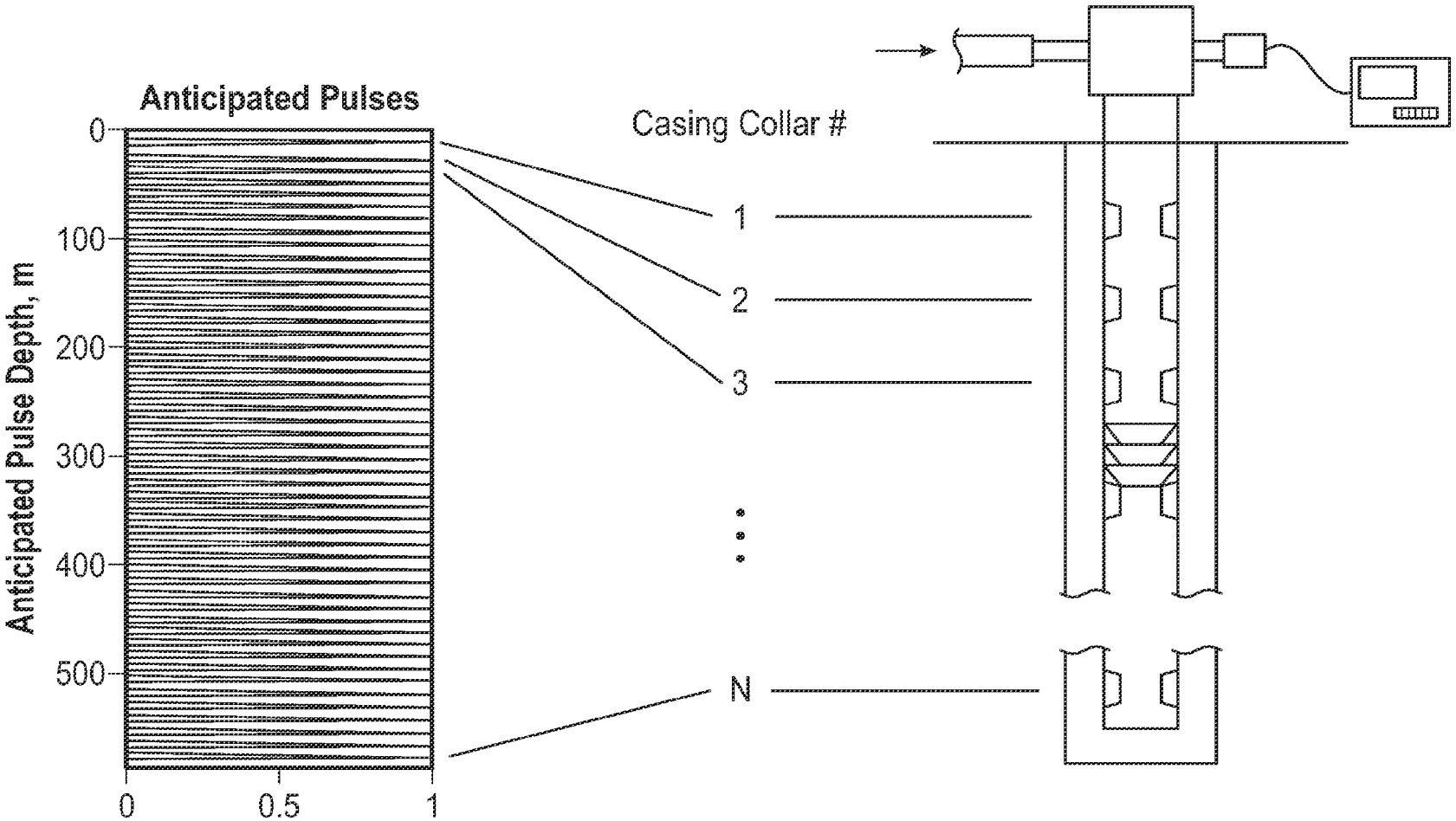
FIG. 9 shows the depths associated with each pressure pulse, according to the casing tally.

As shown in FIG. 9, the collar pulses plot from FIG. 8(*ii*)(*e*) may then be compared with a known casing tally to determine the depth of the cementing plug. Persons skilled in the art will recognize that the position of the bottom plug may be monitored during the period before the top plug is launched.

Figure 10:
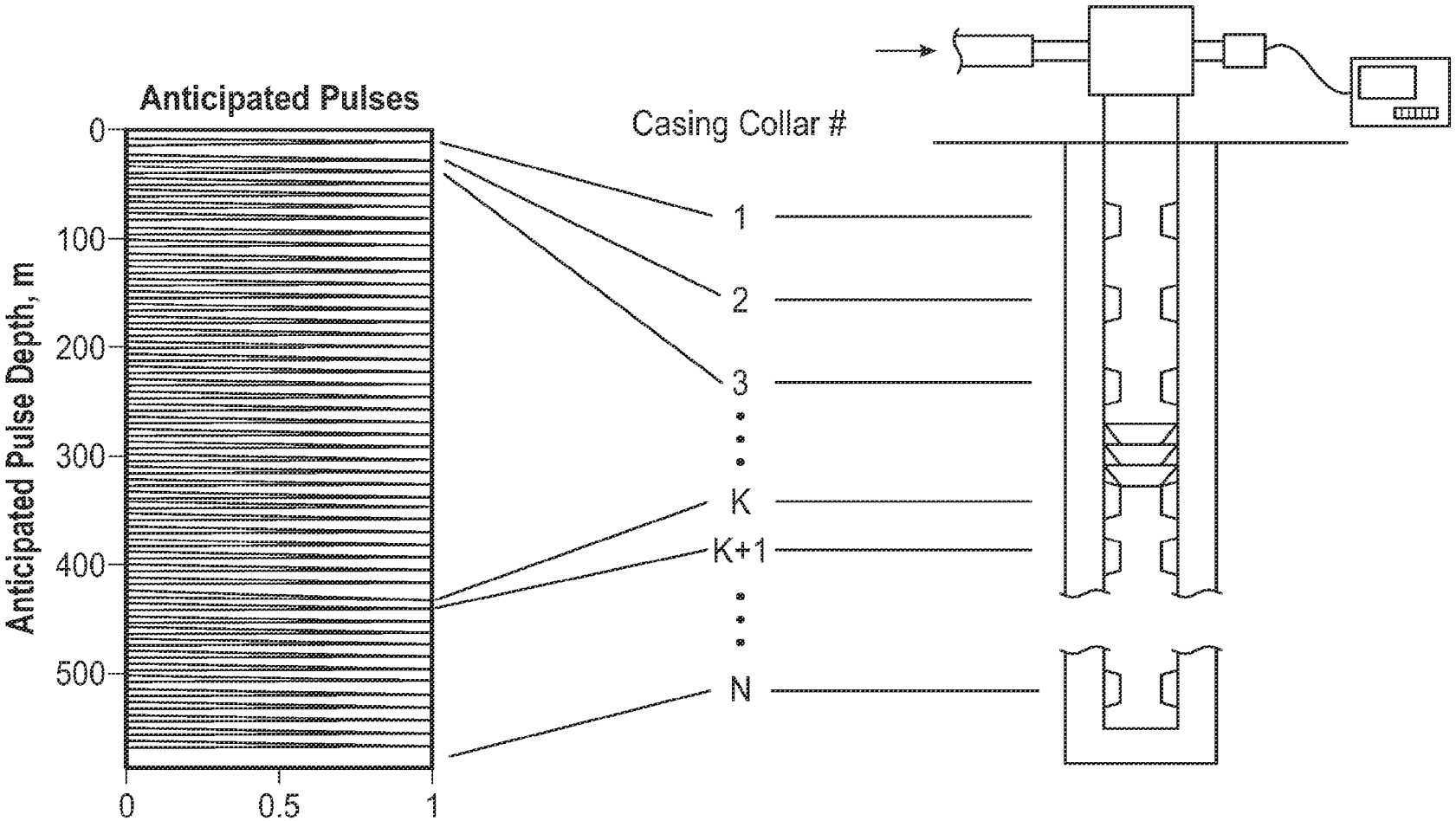
FIG. 10 shows pressure pulses according to a casing tally when casing joints of non-uniform spacing are present.

The workflow described above functions optimally when all of the pulses are clearly seen on the normalized energy spectral density plot. In some cases, the amplitude of one or more pulses may be too low due to tube wave attenuation in the wellbore, or buried with the noise or both. Also, due to the U-tubing effect, the pressure pulses may not be immediately visible after a plug is released from the cementing head, but after the cementing plug has traveled to some depth from the surface. In this case, if all joints have the same length, matching anticipated pulses with the measured ones may be ambiguous. This circumstance may be avoided by installing casing segments at various locations that are shorter or longer than the normal sequence. In other words, the distances between regions with at least one change of inner cross-sectional dimension may be equidistant or non-equidistant. This way, the casing tally should contain one or more shorter or longer joints or their combination so that they can be clearly seen on the measured pulses plot. These pulses would then be used as a benchmark for correlation between anticipated pressure pulses with the casing tally as the collars number K and K+1 shown in FIG. 10.

Aspects of the present disclosure are further discussed in detail in US Patent Application 2021/0062640, Patent Application PCT/RU2020/000694 and Patent Application PCT/RU2020/000405, incorporated by reference herein in their entirety.

The present disclosure further pertains to situations wherein the change of inner cross-section dimension ($d_2-d_1$), as described earlier and illustrated in FIG. 6, is insufficient to generate an adequate pressure pulse as a droppable object passes through the interior of the casing string. The minimum change of inner cross-section dimension has been determined to be about 3 mm.

This problem may be solved by installing special casing joints that have two or more dimensional discontinuities, or positive upsets, having a magnitude sufficient to generate an adequate pressure pulse for detection at the surface (i.e., at least about 3 mm). An upper dimensional limit of the positive upset may be that which would prevent passage of the droppable object through the interior of the casing string. Such an upper limit may depend on the diameter of the casing string. The positive upsets may comprise screw joints, weld joints or both.

Figure 11:
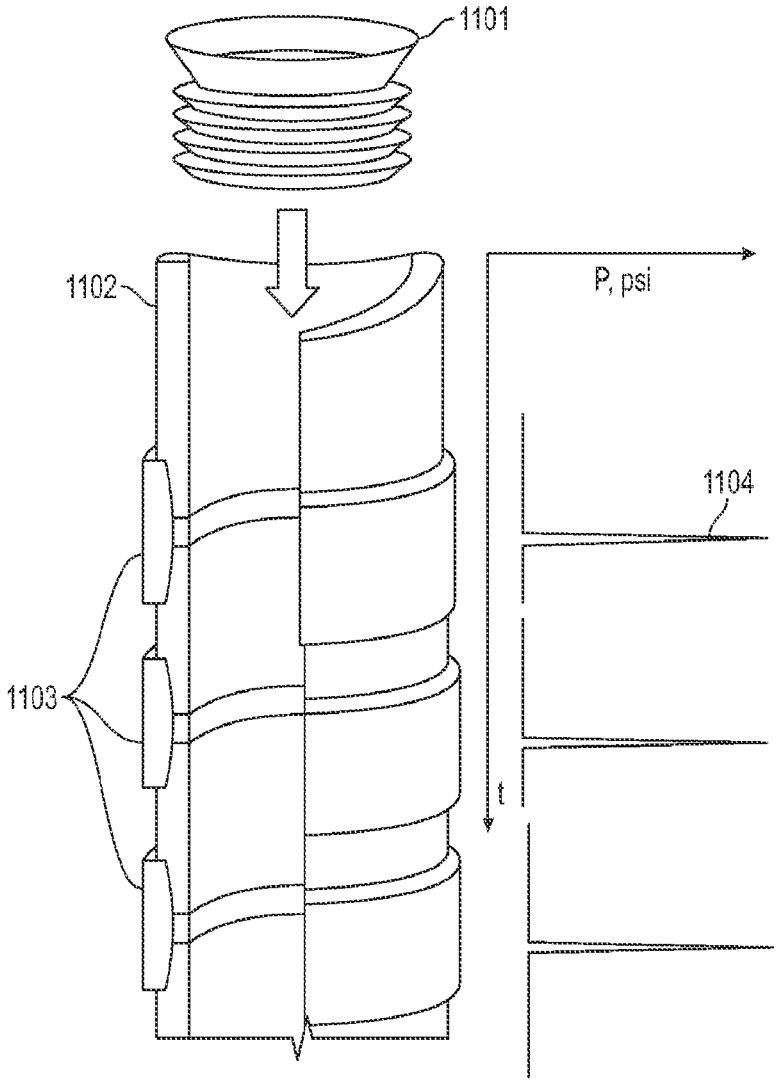
FIG. 11 shows example data from a primary cementing operation: pressure at the wellhead, frequency-time diagram and reflective signal intensity.

An illustration of a special casing joint is shown in FIG. 11. A droppable object 1101 (in this case a cementing plug) passes through the special casing joint 1102. During its journey, the plug encounters and passes by multiple positive upsets 1103, generating pressure pulses 1104 that travel to the surface. The special casing joints are installed at pre-known depths, thus allowing determination of the depths associated with the pressure pulses.

The special casing joint may have a length between about 3 m and 12 m. The inside diameter of the special casing joint may be between about 3 in. and 36 in. There may be three or more positive upsets. In such cases the positive upsets may be equidistant or non-equidistant.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

The invention claimed is:

1. An apparatus, comprising:
- a droppable object;
- a casing string; and
- a casing joint comprising at least three positive upsets, the casing joint being at a pre-known depth in the casing string, the at least three positive upsets all having a same length, and distances between at least two adjacent pairs of the at least three positive upsets being non-equidistant,
- wherein the casing joint is configured such that, during travel through the casing joint, the droppable object encounters at least three of the at least three positive upsets that generate pressure pulses that travel to a surface level.

2. The apparatus of claim 1, wherein each of the at least three positive upsets have a size of at least 3 mm, but smaller than that which would prevent passage of the droppable object through an interior of the casing string.

3. The apparatus of claim 1, wherein the casing joint has a length between 3 m and 12 m.

4. The apparatus of claim 1, wherein the casing joint has an inside diameter between 3 in and 36 in.

5. A method for determining a position of a droppable object inside a casing string, comprising:
- installing the casing string into a liquid-filled borehole, the casing string comprising at least one casing joint installed at a pre-known depth, the at least one casing joint comprising at least three positive upsets, the at least three positive upsets all having a same length, and distances between at least two adjacent pairs of the at least three positive upsets being non-equidistant,
- wherein a minimum magnitude of the at least three positive upsets is at least about 3 mm but smaller than that which would prevent passage of the droppable object through an interior of the casing string;
- installing a pressure data acquisition system at a wellsite;
- installing a pressure transducer at a wellhead at the wellsite;
- placing the droppable object inside the casing string;
- pumping a fluid behind the droppable object, causing the droppable object to travel through the interior of the casing string and pass through the at least one casing joint that comprises the at least three positive upsets, the droppable object encountering and passing by at least three of the at least three positive upsets during its journey through the at least one casing joint, thereby generating pressure pulses that travel to a surface level;
- recording pressure data with the pressure transducer;
- transmitting the pressure data to the pressure data acquisition system; and
- mathematically processing the pressure data, the mathematically processing comprising:
  - obtaining at least one of: the pressure pulse or a pressure pulse reflection; and
  - determining the position of the droppable object based on the obtained at least one of: the pressure pulses or the pressure pulse reflection.

6. The method of claim 5, wherein the droppable object comprises one or more of: a top cementing plug, a bottom cementing plug, or a drill pipe dart.

7. The method of claim 5, wherein the mathematically processing at least one of: the pressure pulses or the pressure pulse reflection further comprises:
- cepstral analysis, the cepstral analysis comprising producing a pressure cepstrogram in coordinates of quefrency and time; and
- calculating a pressure pulse reflection time from the droppable object traveling through the casing string.

8. The method of claim 5, wherein the mathematically processing further comprises determining a tube wave velocity, based on a pressure pulse reflection time from a stationary object with a known position in the borehole.

9. The method of claim 5, wherein a pressure pulse reflection time from the droppable object is converted to the position of the droppable object by multiplication by tube wave velocity.

10. The method of claim 5, wherein:
- the mathematically processing further comprises at least one of:
  - analyzing a pressure spectrogram and determining pressure pulses; or
  - analyzing a normalized energy spectral density of the pressure data; and
- the normalized energy spectral density is computed by integrating the pressure spectrogram along a frequency axis followed by normalization or a correlation between anticipated pressure pulses based on casing tally information and the pressure pulses from the pressure spectrogram or normalized energy spectral density.

11. The method of claim 5, wherein the determining the position of the droppable object is performed in real time during pumping, allowing an operator to control movement of the droppable object.

12. The method of claim 5, wherein the fluid is a displacement fluid.

13. The method of claim 5, further comprising:

determining that a change of inner cross-section dimension at a casing collar joint is insufficient to generate an adequate pressure pulse as the droppable object passes through the casing string; and installing the casing joint in response to the determining that the change of inner cross-section dimension at the casing collar joint is insufficient, wherein the casing joint comprises the at least three positive upsets configured to generate pressure pulses detectable at the surface.

14. A method for cementing a borehole penetrating a subterranean formation, comprising:

installing a casing string into the borehole, the borehole being liquid-filled, the casing string comprising at least one casing joint installed at a pre-known depth, the at least one casing joint comprising at least three positive upsets, the at least three positive upsets all having a same length, each of the at least three positive upsets comprising at least one of: a screw joint or a weld joint, distances between at least two adjacent pairs of the at least three positive upsets being non-equidistant, wherein a minimum magnitude of the at least three positive upsets is at least about 3 mm but smaller than that which would prevent passage of a top cementing plug through an interior of the casing string;

installing a pressure data acquisition system at a wellsite;

installing at least one pressure transducer at a wellhead at the wellsite;

placing the top cementing plug inside the casing string;

pumping a displacement fluid behind the top cementing plug, causing the top cementing plug to travel through the interior of the casing string and pass through the at least three positive upsets, the top cementing plug encountering and passing by at least three of the at least three positive upsets during its journey through the at least one casing joint, thereby generating pressure pulses that travel to a surface level;

using the at least one pressure transducer to detect the pressure pulses and transmit pressure data to the pressure data acquisition system, the pressure data comprising:

pressure pulse propagation velocity; and reflection time; and processing the pressure data mathematically, the processing comprising determining a position of the top cementing plug based on the pressure data.

15. The method of claim 14, further comprising:

placing a bottom cementing plug inside the casing string;

pumping a cement slurry behind the bottom cementing plug, causing the bottom cementing plug to travel through the interior of the casing string and pass through the at least three positive upsets, thereby generating a pressure pulse;

using the at least one pressure transducer to detect the pressure pulse and transmit pressure data to the pressure data acquisition system, the pressure data comprising a pressure pulse propagation velocity and a reflection time; and processing the pressure data mathematically and determining the position of the bottom cementing plug.

16. The method of claim 15, wherein the processing comprises:

cepstral analysis, the cepstral analysis comprising producing a pressure cepstrogram in coordinates of quefrency and time; and calculating the pressure pulse reflection time from the top cementing plug or the bottom cementing plug.

17. The method of claim 14, wherein the processing further comprises determination of tube wave velocity, based on reflection time from a stationary object with a known position in the borehole.

18. The method of claim 14, wherein reflection time from the top cementing plug is converted to the position of the top cementing plug by multiplication by tube wave velocity.

19. The method of claim 14, wherein:

the processing comprises at least one of:

analyzing a pressure spectrogram and determining pressure pulses; or analyzing a normalized energy spectral density of the pressure data; and the normalized energy spectral density is computed by integrating the pressure spectrogram along a frequency axis followed by normalization or a correlation between anticipated pressure pulses based on casing tally information and pressure pulses from the pressure spectrogram or normalized energy spectral density.

20. The method of claim 14, wherein the determining the position of the top cementing plug is performed in real time during pumping, allowing an operator to make instant decisions concerning treatment progress.

21. The method of claim 14, wherein a velocity of tube wave propagation is determined from measurements recorded while cementing a previous section or a neighboring well with similar characteristics.

* * * * *